United States Patent [19]

Bandukwalla

[11] Patent Number: 4,820,115

[45] Date of Patent: Apr. 11, 1989

[54] OPEN IMPELLER FOR CENTRIFUGAL COMPRESSORS

[75] Inventor: Phiroze Bandukwalla, Olean, N.Y.

[73] Assignee: Dresser Industries, Inc., Dallas, Tex.

[21] Appl. No.: 119,838

[22] Filed: Nov. 12, 1987

[51] Int. Cl.[4] ..... F04D 29/08

[52] U.S. Cl. ..... 415/98; 415/106; 415/170 B; 416/188

[58] Field of Search ..... 415/97, 98, 106, 109, 415/170 A, 170 B, 172 R, 175, 176; 416/183, 185, 188

[56] References Cited

U.S. PATENT DOCUMENTS

| | | | |
|---|---|---|---|
| 721,207 | 2/1903 | Lockwood | 415/109 |
| 1,967,316 | 7/1934 | Meeker | 415/170 A |
| 3,123,010 | 3/1964 | Witt et al. | 415/106 X |
| 3,277,222 | 7/1976 | Jagusch et al. | 55/407 |
| 3,481,531 | 12/1969 | MacArthur et al. | 416/188 X |
| 4,277,222 | 3/1981 | Barbeau | 415/177 |
| 4,527,947 | 7/1985 | Elliott | 415/98 X |
| 4,613,281 | 9/1986 | Lubieniecki | 415/98 X |

FOREIGN PATENT DOCUMENTS

| | | | |
|---|---|---|---|
| 2307714 | 8/1973 | Fed. Rep. of Germany | 416/188 |
| 53-62203 | 6/1978 | Japan | 415/170 B |
| 896366 | 5/1962 | United Kingdom | 415/106 |

*Primary Examiner*—Robert E. Garrett
*Assistant Examiner*—Joseph M. Pitko
*Attorney, Agent, or Firm*—Roy L. Van Winkle; William R. Peoples; Edward G. Fiorito

[57] ABSTRACT

An improved open impeller for centrifugal compressors or the like that includes a hub portion and a disc portion having front and rear surfaces. A plurality of circumferentially spaced blades are positioned on the front surface of the impeller disc. A plurality of circumferentially spaced vanes are located on the rear suface of the disc and generally located between adjacent ones of the blades. The vanes are elongated and have their chords disposed at an angle relative to a radius of the circle on which the vanes are disposed to generate a pressure preventing gas exiting the blades from passing behind the rear surface of the impeller. Also, the vanes may be angled relative to the rear surface to produce a thrust counteracting the thrust produced by the impeller blades. The arrangement of the vanes is such that rigidity is provided to the impeller disc reducing the vibration of the disc when rotating at high speeds.

2 Claims, 1 Drawing Sheet

OPEN IMPELLER FOR CENTRIFUGAL COMPRESSORS

BACKGROUND OF THE INVENTION

This invention relates generally to impellers for centrifugal compressors. More particularly, this invention relates to an improved open impeller for a centrifugal compressor that has a plurality of circumferentially spaced vanes located on the rear face of the impeller.

The high rotational speeds now used in centrifugal compressors has resulted in vibration of impeller discs which may reduce the efficiency of the compressor or result in the destruction of the impeller and perhaps the compressor. In an effort to alleviate the vibrational problems, ribs or flutes have been utilized on the face of the impeller between adjacent impeller blades.

Discs having relatively large thickness have also been utilized to overcome the vibration problems. With the thicker disc impellers, greater strength and more costly materials have been required which increase the cost of the compressor. Also, the use of the thicker discs have the side effect of causing shaft and bearing problems due to the high rotational speed of the greater mass.

U.S. Pat. No. 4,277,222, issued July 7, 1981, to Dennis E. Barbean illustrates a relatively thin disc impeller that includes two circumferential rings on the back or rear surface of the impeller. The rings inherently provide more rigidity to the relatively thin disc of the impeller. As patented therein however, the rings are provided as annular seals. The use of rings results in hoop stresses being increased in the hub of the impeller. It should be noted that the use of rings is an improvement over the thicker discs which also cause hoop stress problems in the hub.

An object of this invention is to provide an improved open impeller design wherein the impeller disc can be constructed from relatively thin material and yet avoid vibrational problems by incorporating a plurality of circumferentially spaced vanes on the rear surface of the disc that are located generally between the impeller blades. The use of circumferentially spaced vanes also avoids the introduction of additional hoop stresses into the impeller hub.

SUMMARY OF THE INVENTION

This invention provides an improved open impeller for a centrifugal compressor comprising a hub portion having an axis of rotation and a bore therethrough for receiving a rotatable shaft; an annular disc portion extending radially from said hub portion having an outer periphery, front surface and a rear surface; a plurality of circumferentially spaced blades located on and projecting axially from the front surface of the disc portion and extending generally from the hub portion to the outer periphery; and, plurality of elongated vanes located on the rear surface proximate the outer periphery thereof and disposed between the blades with the longer dimension of the vanes aligned generally tangentially to a circle having as its center of the axis of rotation.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
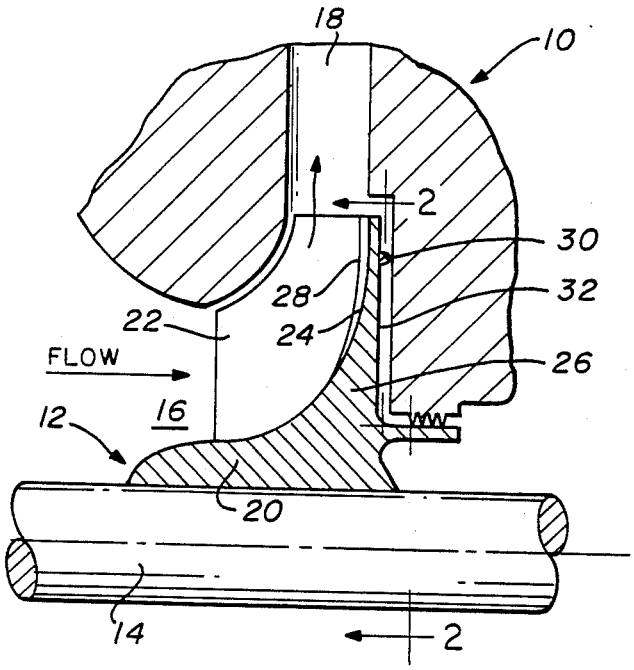
FIG. 1 is a fragmentary, cross-sectional view illustrating an impeller that is constructed in accordance with the invention and located in a compressor.
Figure 2:
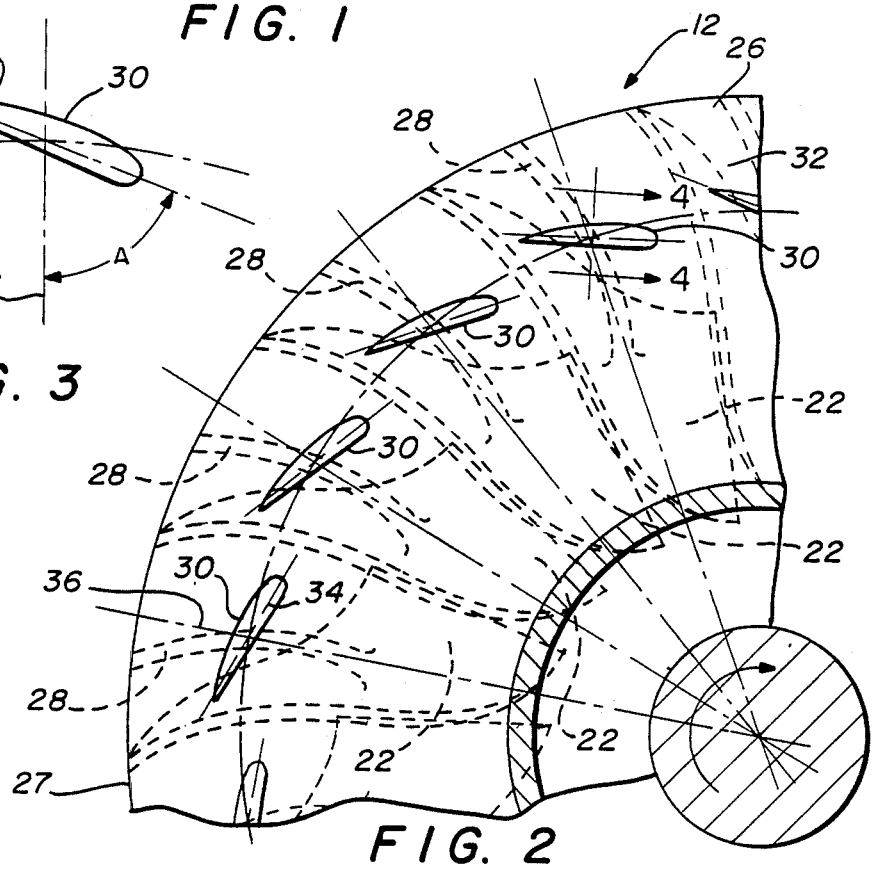
FIG. 2 is a fragmentary view of the impeller of FIG. 1 taken generally along the line 2—2 of FIG. 1.

Referring to the drawing and to FIGS. 1 and 2 in particular, shown therein and generally designated by the reference character 10 is a portion of a centrifugal compressor that includes an impeller 12 that is constructed in accordance with the invention. The impeller 12 is illustrated as being mounted on a shaft 14 that is rotatable in the compressor 10 to cause rotation of the impeller 12. The compressor 10 includes an inlet 16 and a diffuser passageway 18 through which gas is discharged from the impeller 12.

The impeller 12 includes a hub portion 20 that closely encircles the shaft 14 and is attached thereto by means not shown, a plurality of circumferentially spaced blades 22 located on the front surface 24 of a disc portion 26. The blades 22 are illustrated in dash lines in FIG. 2. The blades 22, which may be seen most clearly in FIG. 2, extend generally radially from the hub 20 toward an outer periphery 27.

Also located on the front surface 24 of the disc portion 26 are a plurality of generally radially extending ribs or flutes 28. The ribs 28 are shown in dash lines in FIG. 2 and as shown therein, the ribs 28 are disposed between adjacent blades 22 and extend generally parallel thereto.

The ribs 28 may be a plurality of smaller ribs than illustrated located between blades rather than just one as illustrated. The ribs 28 serve the purpose of stiffening the impeller disc 26 against one mode of vibration and also to increase efficiency of the blades somewhat by streamlining the gas flow and by preventing low velocity boundary layer flow from migrating from the pressure to the suction surfaces of the blade that is, from the front surface to the rear surface of the blade 22.

Figure 3:
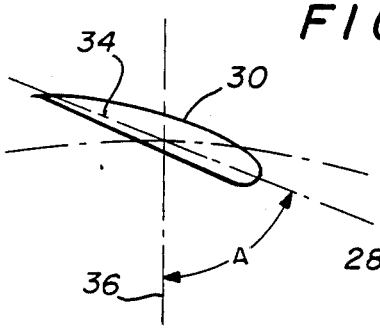
FIG. 3 is a view illustrating the angular relationship between the vanes and the radii of the impeller of FIGS. 1 and 2.

The impeller 12 is also provided with a plurality of circumferentially spaced vanes 30. The vanes 30 preferably have an airfoil configuration as illustrated in FIG. 3. As shown in FIG. 2, the vanes are located on a circle having as its center the rotational axis of the shaft 14. The circumferential spacing of the vanes 30 is preferably such that they are located between adjacent blades 22 and thereby provide a stiffness to the impeller disc 26 in another mode of vibration as compared to the effect of the ribs The vanes 30 are located on a rear surface 32 of the impeller disc 26. That is, they are located on the opposite side of the disc 26 as compared to location of blades 22 and ribs 28.

The orientation of the vanes 30 can be more clearly seen in FIG. 3. As shown therein, a cord 34 of each of the vanes is disposed at an angle A relative to a radius 36 which extends from the rotational axis of the shaft 14. The angle A may be changed when manufacturing the impeller 12 so that a selected positive pressure may be generated by the vanes 30 to prevent the flow of gas from the diffuser passageway 18 to the rear surface 32 of the impeller 12.

The angle A can be varied from about 90° wherein the cord 34 of the vanes 30 is tangent to the circle defined by the radius 36 to about 80°. Preferably, the angle A will be between 85° and 88° and generally around 85°.

Figure 4:
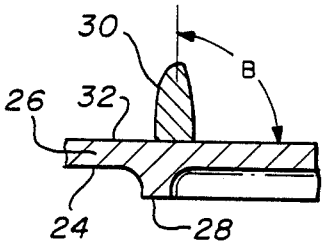
FIG. 4 is a fragmentary cross-sectional view enlarged to show the angular relationship between the vanes and the rear surface of the impeller disc.

In FIG. 4, it can be seen that the vanes 30 are disposed at an angle B relative to the rear surface 32 of the impeller disc 26. The angle B may also be changed during manufacture to generate an axial thrust on the impeller 12 that is in a direction toward the inlet 16. The generation of such an axial thrust aids in counteracting the axial thrust generated by the blades 22.

The angle B can be varied from about 90° as illustrated wherein little if any thrust will be developed to about 80° for generating the maximum desired thrust. Preferably, the angle B will be about 85°.

In operation, the shaft 14 of the compressor 10 will be rotating driving the impeller 12 therewith and causing gas flow from the inlet 16 through the blades 22 and out through the diffuser passageway 18 at an increased pressure. Due to the pressure generated by the vanes 30 located on the rear surface 32 of the impeller 12 toward the outer periphery 27 of the impeller 12, none of the gas flows from the outer periphery 27 of the disc portion 26 toward the shaft 14 along the rear surface 32.

The outer periphery 27 can be varied at manufacturing, to give the desired stiffness and net thrust. In fact all three variables "A", "B" and 27 are used to provide optimum design/operating point-conditions.

As the impeller 12 rotates at a extremely high speed, vibration of the disc portion 26 of the impeller 12 is substantially reduced by the presence of the ribs 28 located on the front surface 24 between the blades 22 and by the vanes 30 located on the rear surface 32 thereof. As previously mentioned, the ribs 28 function to change the vibrational response in one mode while the vanes 30 change the vibrational response in another mode.

From the foregoing, it can be seen that a open impeller 12, constructed in accordance with the invention, provides a means for increasing the efficiency of the compressor 10 by the aerodynamic action of the ribs 28 and of the vanes 30, reduces vibration of the impeller 12, and provides a thrust balancing effect when the vanes 30 are canted relative to the rear surface of the disc portion 26.

The above described technique of balancing thrust and providing the desired stiffness, without increasing the weight of the impeller or increasing the stress, need not be limited to open face impellers. The same technique can be used for any rotating discs that may require thrust balance and/or stiffness and/or weight reduction.

It will also be appreciated that the single embodiment described in detail herein before was presented by way of example only and that many changes and modifications can be made thereto without departing from the spirit or scope of the invention.

What is claimed is:

1. An improved open impeller for a centrifugal compressor comprising:

a hub portion having an axis of rotation and a bore therethrough for receiving a shaft;

an annular disc portion extending radially from said hub portion and having an outer periphery, a front surface, and a rear surface;

a plurality of circumferentially spaced blades located on and projecting axially from the front surface of said disc portion and extending generally from said hub portion to said outer periphery; and, a plurality of elongated vanes, each having a cross-section of generally airfoil configuration located on said rear surface proximate said outer periphery and disposed between said blades with a chord of each of said vanes aligned generally tangent to a circle having as its center said axis of rotation.

2. The impeller of claim 1 wherein said vanes are set at an angle relative to said rear surface to produce axial thrust toward said rear surface when said impeller is rotating for counteracting the axial thrust generated by said blades.

* * * * *